United States Patent [19]

Gerber

[11] 4,362,077

[45] Dec. 7, 1982

[54] APPARATUS FOR WORKING ON SHEET MATERIAL AND HAVING MAGNETIC HOLDDOWN MEANS

[75] Inventor: Heinz J. Gerber, West Hartford, Conn.

[73] Assignee: Gerber Garment Technology, Inc., South Windsor, Conn.

[21] Appl. No.: 242,067

[22] Filed: Mar. 9, 1981

[51] Int. Cl.[3] ..... D06H 7/00

[52] U.S. Cl. ..... 83/453; 83/452; 83/925 CC; 269/8

[58] Field of Search ..... 83/374, 375, 451-453, 83/925 CC; 269/8

[56] References Cited

U.S. PATENT DOCUMENTS 3,387,841 6/1968 Menell et al. ..... 269/8 X
3,712,166 1/1973 Rossetti ..... 83/451 X
3,776,072 12/1973 Gerber et al. ..... 83/374 X
3,790,154 2/1974 Gerber et al. ..... 83/451 X
3,837,084 9/1974 Johnson ..... 269/8 X

*Primary Examiner*—James M. Meister
*Attorney, Agent, or Firm*—McCormick, Paulding & Huber

[57] ABSTRACT

Sheet material spread on a cutting table is clamped to the surface of the table by parallel flexible bands of ferromagnetic material attracted to the table by magnets associated with the table. The bands are threaded under and over rollers journalled on a tool carriage which moves a cutter wheel in cutting engagement with the sheet material in response to command signals received from a programmable computer. The rollers pick up portions of the bands ahead of the carriage assembly and lay down portions of the bands behind it as the carriage assembly advances longitudinally of the table.

13 Claims, 2 Drawing Figures

APPARATUS FOR WORKING ON SHEET MATERIAL AND HAVING MAGNETIC HOLDDOWN MEANS

BACKGROUND OF THE INVENTION

This invention relates in general to apparatus for working sheet material and deals more particularly with improvements in apparatus of the type which includes a sheet material supporting surface and a tool carriage assembly for moving a tool in working relation to sheet material spread on the supporting surface in response to command signals received from a programmable computer.

In a machine of the aforedescribed general type, the programmed movements of the tool are relative to the supporting surface. Accordingly, in order to achieve accuracy in the finished work product it is essential that the sheet material be held in firmly fixed position relative to supporting surface. In a machine of the type wherein the tool moves in direct working engagement with the sheet material, as, for example, in a machine where the tool is a cutting tool or a marking tool, it is highly desirable that the material be held firmly against the supporting surface in the region of the tool so that working pressure exerted upon the material by the tool does not cause the material to shift relative to the supporting surface.

Heretofore various apparatus for working on sheet material has been provided which includes means for holding sheet material in engagement with a supporting surface in proximity to a working region of a tool. Vacuum holddown tables have proven particularly effective for this purpose, however, such tables are relatively expensive to produce and require vacuum producing equipment, which adds materially to the construction and operational costs of the equipment.

Accordingly, it is the general aim of the present invention to provide improved programmable apparatus for working on sheet material and which includes relatively simple magnetic or electromagnetic means for firmly holding sheet material in fixed position relative to a supporting surface and in close proximity to the operating region of a tool which works upon the sheet material.

SUMMARY OF THE INVENTION

In accordance with the present invention, an improved apparatus for cutting sheet material includes a table which has a supporting surface upon which sheet material to be cut is spread, a programmable controller, a tool, and a tool carriage assembly supporting the tool for movement relative to the supporting surface and in working relation with sheet material spread on the supporting surface in response to command signals received from the controller. The apparatus further includes at least one strip or band of flexible material arranged in overlying relation with associated portions of the sheet material spread on the table, magnetic means for maintaining portions of the strip in fixed clamping relation to the table to clamp associated portions of the sheet material to the table, and strip supporting means for maintaining another portion of the one strip in the region of the tool in spaced relation to the sheet material.

DETAILED DESCRIPTION OF PREFERRED EMBODIMENT

Figure 1:
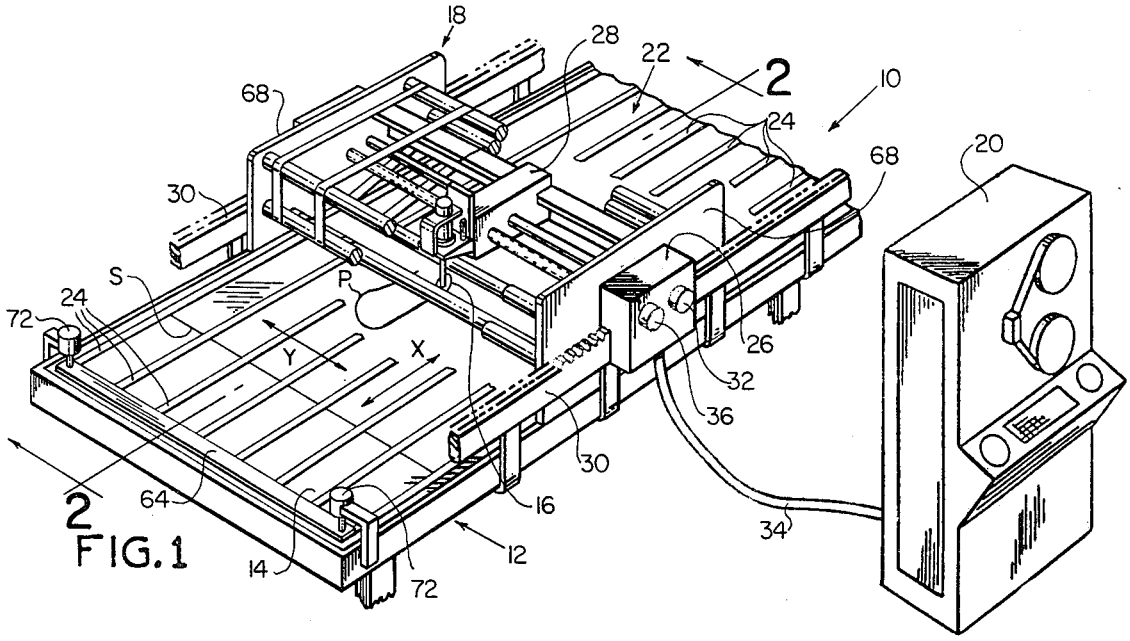
FIG. 1 is a fragmentary perspective view of an apparatus for cutting sheet material and embodying the present invention.

Turning now to the drawing, an automatically controlled apparatus for working on sheet material and embodying the present invention is indicated generally by the reference numeral 10. The illustrated machine 10 is particularly adapted for cutting relatively thin sheet material as, for example, a single ply or a layup which comprises a few plies of sheet material, and includes the table assembly, indicated generally at 12 which has a smooth, relatively hard upwardly facing sheet material support surface 14. The cutting tool comprises a cutting wheel 16, preferably not less than one inch (2.54 cm) in diameter, which rolls freely in cutting engagement with sheet material, such as a sheet of limp fabric S shown spread on the support surface 14. The cutting wheel 16 is supported on a tool carriage assembly, indicated generally at 18, which moves the cutting wheel 16 in longitudinal and transverse directions relative to the table 12 in response to command signals received from a programmable numerical controller 20. The controller also controls movements of the cutting wheel 16 relative to the carriage assembly 18 so that the machine 10 may be programmed to move the cutting wheel along predetermined lines of cut to form pattern pieces from the sheet material as, for example, pattern pieces used in the manufacture of a garment, such as a shirt.

As is usual in a machine of this type, the sheet material must be held firmly in fixed position on the support surface so that each pattern piece produced by the machine will be an accurate duplicate of a corresponding pattern piece defined by a predetermined taped program read by the controller 20. In accordance with the present invention, the illustrated machine 10 has a sheet material holding means designated generally by the numeral 22 and which includes at least one band or strip of flexible material 24 which extends longitudinally of the support surface 14 to overlie associated portions of the sheet material S. A magnetic means is provided for biasing portions of the strip toward the support surface 14 to firmly clamp associated portions of the sheet material S in fixed position relative to the support surface. A strip supporting mechanism is also provided for maintaining another portion of the strip 24 in the region of the cutting wheel 16 in spaced relation to the support surface 14 so that the cutting wheel may be moved freely over the support surface 14 without risk of interference with the band 24, all of which will be hereinafter more fully discussed.

Considering now the machine 10 in further detail, the carriage assembly 18 includes an X-carriage 26 and a Y-carriage 28. The X-carriage 26 is supported for longitudinal translation over the support surface 14 in one or an opposite X coordinate direction by a set of racks 30, 30 which are engaged by pinions (not shown) driven by an X-drive motor 32 which is energized by command signals transmitted by the controller 20 through a cable 34. The Y-carriage 28 is mounted on the X-carriage 26 for movement transversely of the table 12 and relative to the carriage 26 in Y coordinate directions, and is translated by a Y-drive motor 36 which drives a lead screw 38 which is journalled upon and extends transversely of the X-carriage 26. Like the motor 32, the drive motor 36 is also energized in response to command signals received through the cable 34 from the controller 20.

The cutting wheel 16 is suspended below a platform 40 attached to a projecting end of the Y-carriage 28. The suspension includes a pneumatically or hydraulically operated actuator 42 supported above the platform 40 by a frame 44. The actuator 42 has a cylinder 45, a piston 46 and a piston rod 47 connected to the piston and to the cutting wheel 16 through a swivel connection 48 and a square drive rod 50. The cutting wheel 16 is journalled for free rotation in a bifurcated lower end of the drive rod 50.

The actuator or fluid motor 42 is utilized to lower the cutting wheel 16 into cutting engagement with sheet material on the table 12, as well as to provide downward force to press the sharp cutting edge of the wheel 16 against the supporting surface 14, whereby to shear the sheet material S during the cutting cycle. Pneumatic or hydraulic fluid pressure delivered to the fluid motor 42 through a supply line 51 operates on the upper surface of the piston 46 to lower the piston and the cutting wheel 16 and to exert downward force upon the cutting wheel. A coil spring 52 which encircles the upper end of the piston rod 47 acts between the piston rod 47 and the cylinder 45 to urge the piston and the cutting wheel upwardly to the broken line position shown in FIG. 2 when pressure within the cylinder 45 is relieved. Thus, by controlling pressure within the cylinder 45, the cutting wheel 16 may be brought into or out of engagement with sheet material S spread on the cutting table 12, but in the event of power failure, the coil spring 52 raises the cutting wheel to a fail-safe position above the supporting surface 14.

In order to cut along a predetermined path, such as the path P shown in FIG. 1, the cutting wheel 16 must not only be translated over the table 12 by the carriages 26 and 28 but also must be oriented in the direction of its travel. Accordingly, the square drive rod 50, which carries the cutting wheel 16, is slidably engaged with a toothed pulley 54 which is coupled by another toothed pulley 56 and a toothed timing belt 58 to a $\theta$-drive motor 60. The motor 60 rotates the drive rod 50 about its axis to orient the cutting wheel 16 in its direction of travel in response to command signals received from the controller 20. The swivel connection 48 permits the drive rod to rotate independently of the piston rod but raises and lowers the drive rod through the pulley 54. Thus, coordinated movements of the carriages 26 and 28 translate the cutting wheel 16 along a cutting path over any area of the supporting surface 14 while the drive motor 60 simultaneously orients the cutting wheel 16 in its direction of travel. For further disclosure of a machine of the aforedescribed type, reference may be had to application Ser. No. 168,312 of Heinz Joseph Gerber and David R. Pearl for METHOD AND APPARATUS FOR CUTTING SHEET MATERIAL WITH A CUTTING WHEEL, filed July 10, 1980, assigned to the assignee of the present invention, and hereby adopted by reference as part of the present disclosure.

As previously noted, the holding mechanism 22 which comprises the present invention includes at least one flexible strip or band 24. However, preferably, and as shown, the holding mechanism comprises a plurality of parallel spaced bands 24, 24 which extend longitudinally of the table 12 in parallel relation to each other. The illustrated bands 24, 24 are made from flexible ferromagnetic material, the ends of the bands being secured to anchor strips 64, 64 (one shown in FIG. 1), which extend transversely of the table 12 at its opposite ends.

Figure 2:
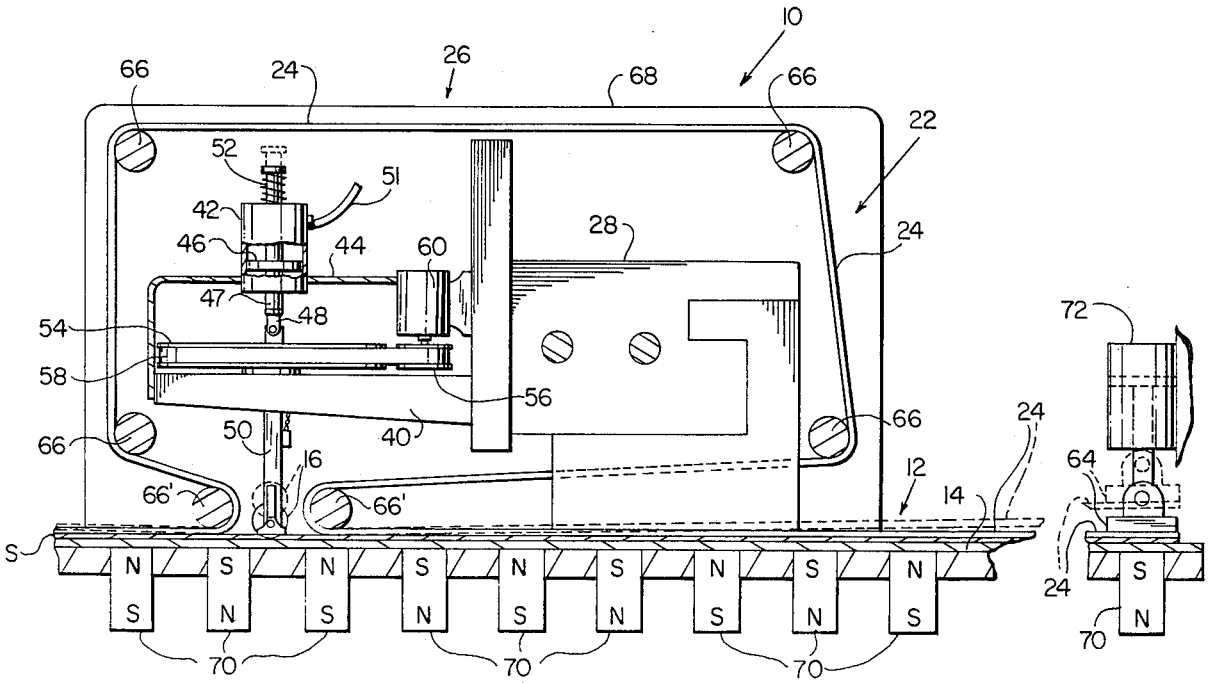
FIG. 2 is a somewhat enlarged fragmentary sectional view of the machine of FIG. 1 taken generally along the line 2—2 of FIG. 1.

The bands 24, 24 are supported in the region of the cutter by a plurality of rollers 66, 66 which extend transversely of the tool carriage assembly 18 in axially parallel relation to each other. The rollers 66, 66 are journalled on support plates 68, 68 respectively mounted at opposite sides of the X-carriage 26 to travel with it and relative to the table 12. Two of the rollers, indicated at 66′, 66′, are mounted in close proximity to the supporting surface 14 ahead of and behind the cutting wheel 16, as best shown in FIG. 2. The bands 24, 24 are threaded under and over the rollers 66, 66, in a serpentine path, as shown in FIG. 2. The rollers 66, 66 maintain portions of the bands 24, 24 in spaced relation to the supporting surface 14 in the region of the tool or cutting wheel 16.

The bands 24, 24 are biased toward engagement with the supporting surface 14 by magnetic force. The means for providing this magnetic force may vary and may, for example, comprise a plurality of electromagnets associated with the table 12 and mounted below the support surface 14. However, for simplicity of illustration, a plurality of permanent magnets 70, 70 are shown in FIG. 2 imbedded in the table top immediately below the support surface 14.

In order to facilitate the spreading of sheet material to be cut onto the support surface 14, some provision is preferably made to raise at least portions of the bands 24, 24 above the support surface so that sheet material may be moved onto the support surface without interference from the bands. For this purpose, the illustrated machine 10 has fluid motors 72, 72 connected to the anchor strips 64, 64 for lowering the anchor strips to positions wherein portions of the bands 24, 24 associated with the anchor strips are generally adjacent the support surface 14 and raising the anchor strips to positions wherein the associated portions of the bands are spaced some distance above the support surface 14, as indicated in broken lines in FIG. 2. Additional means (not shown) may be provided for raising and lowering the two rollers 66′, 66′ relative to their respectively associated support plates 68, 68 whereby the bands 24, 24 associated with the support surface 14 may be moved to positions of vertically spaced parallel relation to the support surface 14. The fluid motors 72, 72 and the devices for elevating the rollers 66′, 66′ will, of course, exert sufficient upwardly directed force upon the bands 24, 24 to overcome the holding force exerted upon the bands by the permanent magnets 70, 70. When an arrangement, such as aforedescribed, is provided for moving the bands away from the material supporting surface, it may be preferable to utilize electromagnetic biasing means so that the biasing force may be readily cutoff when the bands 24, 24 are to be raised above the support surface.

In operation, the magnets 70, 70 exert downwardly directed force upon the ferromagnetic bands 24, 24 so that sheet material S on the support surface 14 is effectively clamped between the bands and the support surface. As the carriage assembly 18 advances longitudinally of the table 12 in either direction the rollers 66, 66 pick up associated portions of the bands 24, 24 ahead of the carriage assembly and lay down other associated portions of the band behind it. Still other portions of the bands which are supported by the rollers 66, 66 are maintained in spaced relation to the supporting surface 14 so that the cutter wheel 16 may move freely in a region between the bands 24, 24 and the support surface 14 without risk of interference with the bands.

We claim:

1. In an apparatus for working on sheet material and having means defining a support surface for supporting sheet material spread thereon, means for holding the sheet material in fixed position relative to the support surface, a tool carriage assembly, a tool supported by the tool carriage assembly, and means for moving the tool carriage assembly and the tool relative to the support surface to move the tool in working relation to sheet material spread on the support surface, the improvement wherein said means for holding the sheet material comprises at least one strip of flexible material extending longitudinally of said support surface to overlie associated portions of sheet material spread thereon, magnetic means for biasing portions of said one strip toward said support surface to clamp the associated portions of the sheet material in fixed position relative to said support surface, and strip supporting means for maintaining another portion of said one strip in the region of said tool in spaced relation to said support surface as said tool moves relative to said support surface and in working relation to sheet material spread thereon.

2. In an apparatus for working on material as set forth in claim 1 the further improvement wherein said one strip is made from ferromagnetic material and said magnetic means is associated with said means defining said support surface.

3. In an apparatus for working on material as set forth in either claim 1 or claim 2 the further improvement wherein said tool carriage assembly comprises said strip supporting means.

4. In an apparatus for working on sheet material as set forth in claim 3 the further improvement wherein said strip supporting means includes a plurality of rollers journalled on said tool carriage assembly and engaged with said one strip.

5. In an apparatus for working on sheet material as set forth in claim 4 the further improvement wherein said one strip is threaded over some of said rollers and under other of said rollers.

6. In an apparatus for working on sheet material as set forth in claim 4 the further improvement wherein said rollers extend transversely of said support surface in axially parallel relation to each other.

7. In an apparatus as set forth in claim 4 the further improvement wherein at least two of said rollers maintain said one strip in close proximity to said support surface at longitudinally opposite sides of said tool.

8. In an apparatus for working on sheet material as set forth in claim 4 the further improvement wherein said tool is supported on said tool carriage assembly for movement generally between said one strip and said support surface.

9. In an apparatus for working on sheet material as set forth in claim 3 wherein said other portion of said strip is disposed intermediate the opposite end portions of said strip.

10. In an apparatus for working on sheet material as set forth in either claim 1 or claim 2 the further improvement wherein said apparatus includes means for moving an associated portion of said one strip between one position wherein said one strip generally overlies an associated portion of said support surface and another position wherein said associated portion of said one strip is generally spaced from said support surface.

11. In an apparatus for working on sheet material as set forth in either claim 1 or claim 2 the further improvement wherein said apparatus includes a plurality of strips of flexible material arranged in parallel spaced apart relation and extending longitudinally of said support surface.

12. In an apparatus for working on sheet material as set forth in claim 11 the further improvement wherein said tool comprises a rotary cutting wheel.

13. In an apparatus for working on sheet material as set forth in either claim 1 or claim 2 wherein said tool comprises a rotary cutting wheel.

* * * * *